United States Patent [19]

Baker

[11] 4,154,234

[45] May 15, 1979

[54] BREATHING BAG SYSTEM FOR CLOSED CIRCUIT BREATHING APPARATUS

[75] Inventor: Ralph L. Baker, Baltimore, Md.

[73] Assignee: Midori Anzen Company, Ltd., Tokyo, Japan

[21] Appl. No.: 799,318

[22] Filed: May 23, 1977

[30] Foreign Application Priority Data

May 24, 1976 [JP] Japan ..... 51-59189

[51] Int. Cl.[2] ..... A62B 7/00

[52] U.S. Cl. ..... 128/142 R; 128/191 R; 128/202

[58] Field of Search ..... 128/142 R, 142.2, 142.7, 128/202, 191 R, 203

[56] References Cited

U.S. PATENT DOCUMENTS 3,877,425 4/1975 O'Neill ..... 128/142 R

FOREIGN PATENT DOCUMENTS 4378 of 1913 United Kingdom ..... 128/191 R

*Primary Examiner*—Henry J. Recla

*Attorney, Agent, or Firm*—Wenderoth, Lind & Ponack

[57] ABSTRACT

This breathing bag system has exhalation and inhalation bags connected by a carbon dioxide absorption canister. The exhalation bag has therein an oxygen inlet port connectable to a chemical oxygen generator and a relief valve for overpressurized gas within the exhalation bag. The two bags are large in volume and surface area and flexible so as to provide a flexible volume sufficient to store an amount of gas sufficient to support the user, to cool the gas which is received hot due to the exothermic reactions of $O_2$ generation and $CO_2$ absorption, and to minimize the of the system.

1 Claim, 1 Drawing Figure

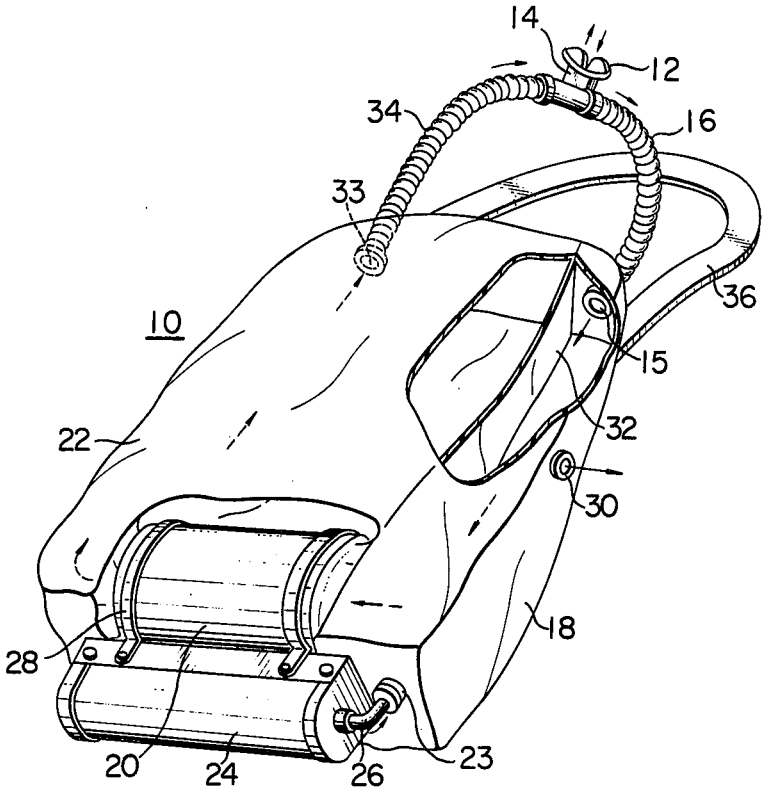
14
12
34
16
33
36
10
15
32
22
30
18
28
20
24
26
23

BREATHING BAG SYSTEM FOR CLOSED CIRCUIT BREATHING APPARATUS

BACKGROUND OF THE INVENTION

This invention relates to breathing bag systems for a closed circuit breathing apparatus and more particularly, to breathing bag systems for use with breathing hoses, a chemical oxygen generator and a carbon dioxide absorption system.

In the event of a fire, a factory accident, a coal mine accident or an oxygen deficiency accident, an antitoxic mask is not effective for protecting the user. To provide a personal breathing apparatus effective under such circumstance, various types of breathing apparatus comprising a self-contained oxygen source have been proposed. Most of them utilize an oxygen bottle or a compressed air bottle as an oxygen source. Although oxygen bottles are more often used because they supply high-purity oxygen gas quite handily, they must be handled and stored with special care. Also, both oxygen and compressed air bottles are heavy, resulting in a heavy and unnecessarily sturdy overall structure for a personal breathing apparatus. Thus, people wearing a breathing apparatus having an oxygen bottle are not able to move quickly to escape in an emergency or to take action in an accident.

On the other hand, it is also known to use a chemical oxygen generator as a source of oxygen. Although a chemical oxygen generator is light in weight and easy to store, it has not been successfully put into practical use mainly because of initial difficulties in obtaining a chemical oxygen generator having a satisfactory performance. Although many high-performance oxygen generators have recently been developed, these generators have not yet been successfully utilized for a personal breathing apparatus. The reasons for this are believed to be (1) that it is difficult to supply oxygen at a stable rate because of the varying oxygen generation rate of these devices, and (2) that it is difficult to cool the generated oxygen gas, which is very hot because of the massive dissociation heat generated during the oxygen generation, to a temperature at which it is safely breathable by the user.

SUMMARY OF THE INVENTION

Accordingly, the object of the present invention is to provide a safe, light weight and compact breathing bag system for use in a closed circuit personal breathing apparatus having a chemical oxygen generator.

Another object of the present invention is to provide a breathing bag system capable of effectively cooling the high temperature breathing gas generating by the system to a breathable temperature.

Still another object of the present invention is to provide a breathing bag system comfortably wearable by the user and which enables the user to move quickly.

To achieve the above objects there is provided a breathing bag system according to the invention which comprises an exhalation bag for storing exhaled gas from the user and an inhalation bag for storing and supplying a breathable gas to the user. These two bags are made of flexible and gas-impermeable material. The exhalation bag and the inhalation bag are coupled to each other through a carbon dioxide absorbing canister to pass the exhaled gas within the exhalation bag through the canister to the inhalation bag, thereby removing carbon dioxide from the exhaled gas and providing a breathable gas. The exhalation bag has an oxygen inlet port connectable to a chemical oxygen source, and the exhalation bag is provided with a relief valve for relieving the pressure built up within the exhalation bag. The exhalation and inhalation bags are connectable to a hermetic mask or a mouthpiece, etc. by flexible hoses.

BRIEF DESCRIPTION OF THE DRAWING

The present invention will become more readily apparent from the following description of the preferred embodiment of the present invention taken in conjunction with the accompanying drawing, in which the single FIGURE is a perspective view of a breathing apparatus using a breathing bag system constructed in accordance with the present invention.

DESCRIPTION OF THE PREFERRED EMBODIMENT

Referring to the drawing, a breathing apparatus 10 into which the breathing bag system of the present invention is incorporated comprises a mouthpiece 12 serving as an interface between the breathing apparatus 10 and the user. The mouthpiece 12 may be of any conventional type comprising a unidirectional switch valve 14 which is connected by a flexible hose 16 to an inlet 15 of an exhalation bag 18. Thus the exhaled gas from the user flows through the mouthpiece 12 and the hose 16 into the exhalation bag 18 wherein the exhaled gas is received and stored. The exhalation bag 18 is made of a relatively thin, flexible and gas-impermeable material such as plastic film. Preferably, the exhalation bag is of flame resistant plastic film such as polyvinyl chloride film, or more preferably, of a refractory material such as tetrafluoroethylene. At the lower side of the exhalation bag 18, a relatively large opening is formed, and the opening communicates with an open end of a cylindrical carbon dioxide absorption canister 20. The carbon dioxide absorption canister 20 may be any well known type containing a carbon dioxide absorbant and serves to absorb carbon dioxide contained in the exhaled gas stored in the exhalation bag 18. The other open end of the carbon dioxide absorption canister 20 is coupled to a large inhalation bag 22. Similar to the exhalation bag 18, the inhalation bag 22 is made of a relatively thin, flexible and gas-impermeable material such as plastic film, preferably of polyvinyl chloride, or more preferably of tetrafluoroethylene.

The exhalation bag 18 also has at its lower end an oxygen inlet port 23 connected to a chemical oxygen generator 24. A typical chemical oxygen generator 24 which may be used in the present invention includes a so-called chlorate candle wherein oxygen is generated by pyrolysis of chlorate. This type of oxygen generator also generates small amounts of carbon dioxide, carbon monoxide, chlorine, etc. in addition to oxygen. Most of the commercially available chlorate candles contain therein an absorbant for these undesirable by-product gases. If the chlorate candle used has no absorbant for these gases or has an absorbant of an insufficient capacity, a by-product gas absorbant may be inserted within the carbon dioxide absorbing canister 20.

The oxygen generator 24 generates oxygen by a chemical reaction and supplies it to the exhalation bag 18 through an oxygen supply pipe 26 connected to the inlet port 23. The outer casing of the oxygen generator 24 is made of a material having good heat dissipation characteristics such as a metal and is secured to the carbon dioxide absorbing canister 20 by any suitable securing means such as support straps 28 secured at their ends to the casing of the oxygen generator 24 and wound around the carbon dioxide absorbing canister 20 which is also made of a metal having good heat dissipation characteristics.

Thus, virtually pure oxygen generated from the oxygen generator 24 is supplied through the inlet port 23 into the exhalation bag 18, wherein the oxygen and the exhaled gas are mixed. The mixed gases in the exhalation bag 18 pass through the canister 20 wherein the carbon dioxide gas contained in the mixture is completely absorbed by the absorbant, thereby allowing only a mixture of pure oxygen and nontoxic gases to flow into the inhalation bag 22. In order to prevent building up of a relatively high pressure in the exhalation bag 18, a relief valve 30 is disposed in the wall of the exhalation bag 18. The relief valve 30 is preferably mounted at a position as remote as possible from the oxygen supply pipe 26 or the inlet port 23 so as to reduce the chances for the high-purity oxygen to escape from the relief valve 30. The relief valve 30 may be set to open a an internal bag pressure of about 60 mm Hg.

The inhalation bag 22 is made of a relatively thin, flexible gas-impermeable material and has a larger volume than that of the exhalation bag 18. The general configuration of the inhalation bag 22 is such that it forms the general contour of the breathing bag system when it is coupled with the exhalation bag 18 as illustrated in the FIGURE. The outlet end of the canister 20 is coupled to a lower projecting portion of the inhalation bag 22, one side wall of the major portion of the inhalation bag 22 is arranged along the outer surface of the canister 24, and another side wall of the major portion of the bag 22 is directly attached to the corresponding wall of the exhalation bag 18. The wall between the two bags 18 and 22 may be a common single partition wall 32 defining two separate spaces as illustrated in the FIGURE. The upper portion of the inhalation bag 22 has an outlet 33, and the outlet 33 is communicated to the mouthpiece 12 through an inhalation hose 34.

In order to assist the user to put on the breathing apparatus 10, a support strap 36 is attached to the upper outer face of the bags 18 and 22. Although not illustrated, a set of pieces of cord may be attached to the outer face of the oxygen generator 24, thereby enabling the user to fit the breathing apparatus on his chest. When in use, the user should use a conventional means for closing the nostrils.

Because of its chemical nature, the chemical oxygen generator 24 generates oxygen gas at a temperature as high as 100° C. and the oxygen temperature can reach 140° C. However, with the breathing apparatus as has heretofore been described, the oxygen gas is cooled by heat exchange action with the atmosphere while the gas is flowing through the oxygen supply pipe 26, the exhalation bag 18 and the inhalation bag 22 which have large surface areas. Also, the casings of the oxygen generator 24 and the carbon dioxide canister 20 have good heat dissipating characteristics so that they cool themselves. Therefore, the mixture of the pure oxygen and air supplied to the user from the mouthpiece 12 will be at a temperature below 50° C. under normal operating conditions, thereby enabling safe respiration.

Even when the amount of oxygen generated from the chemical oxygen generator 24 varies, the flexible, large-volume exhalation bag 18 and the inhalation bag 22 function to absorb or dampen these variations, thereby always maintaining the inner pressure within the bags 18 and 22 at substantially atmospheric pressure, providing no difficulty in breathing by the user. In the event that an excess amount of oxygen is temporarily generated from the oxygen generator 24, or the pressure within the system increases because of an accumulated excess amount of oxygen when the oxygen consumption is less than the oxygen generation, the relief valve 30 opens to release the excess amount of gas from the exhalation bag 18 into the atmosphere.

The breathable gas supplied at the mouthpiece 12 is substantially free from carbon dioxide gas because the direction of flow of the gas within the apparatus is unidirectional. Also, the breathing resistance is very small because the pressure within the system is substantially atmospheric pressure and the exhalation and the inhalation bags 18 and 22 are of large variable volume.

Because the exhalation bag 18 is positioned on the upstream side from the carbon dioxide absorbing canister 20, the exhalation of the gas is achieved against only a slight resistance, and the exhalation rate across the carbon dioxide absorbing canister 20 is equalized. As a result, the capacity of the carbon dioxide absorbing canister 20 does not have to be designed to meet the peak flow rate condition of the exhalation by the user, thereby allowing the absorbing canister to be compact.

The breathing bag system of the present invention is advantageous in that it is very simple and compact in structure, and that the problems with the chemical oxygen generator as previously discussed are effectively solved, providing a superior breathing apparatus as compared with the conventional breathing apparatus utilizing a chemical oxygen generator. Also, the apparatus is light in weight and easy to handle and is compact for convenience in storing.

In order to assure that the above mentioned effects are fully obtained, the exhalation bag 18 and the inhalation bag 22 should both be exposed to the atmosphere without being covered by any thermally nonconductive material such as cloth so as not to reduce the dissipation of heat from the oxygen generation and the carbon dioxide absorption. Also, the exhalation bag 18 and the inhalation bag 22 are designed to have a large volume and a large surface area to enhance the heat dissipation. By making the inhalation bag 22 larger than the exhalation bag 22, a better result will be obtained. The exhalation bag 18 preferably has dimensions of from 1 to 3 liters for the interior volume and of from 600 to 2,000 square centimeters for the outer surface area, while the inhalation bag 22 preferably has dimensions of from 3 to 5 liters for the interior volume and of from 1,500 to 4,000 square centimeters for the outer surface area.

When the breathing apparatus is used with a closed respiration device such as a closed mask or a closed mouthpiece, the inhalation hose 34 and the exhalation hose 16 are preferably independent from each other as illustrated in the FIGURE. The plastic hoses 16 and 34 are connected to a unidirectional valve 14 which allows the exhaled gas only to enter the exhalation hose 16 and which allows the breathable gas only to pass through the inhalation bag 22 to the mouthpiece 12. Since the hoses 16 and 34 are independent, there is only a small chance that the exhaled gas will be inhaled by the user without being purified.

What is claimed is:

1. A breathing bag system for a breathing apparatus having a source of oxygen comprising;

a relatively thin high strength plastic exhalation bag for receiving and storing gas exhaled by a user, said exhalation bag having an outer surface area of from 600 to 2,000 square centimeters and an interior volume of from 1 to 3 liters;

carbon dioxide absorbing means coupled to said exhalation bag for removing carbon dioxide from exhaled gas within said exhalation bag and providing a breathable gas;

said exhalation bag having an inlet port adapted to be directly connected to the source of oxygen to receive oxygen directly from the source of oxygen in said exhalation bag;

a relief valve on said exhalation bag for relieving built-up pressure within said exhalation bag; and an inhalation bag of a relatively thin plastic having good heat transfer characteristics and coupled to said carbon dioxide absorbing means for receiving and storing the breathable gas from said carbon dioxide absorbing means and providing the stored breathable gas to the user, said inhalation bag having a larger interior volume than said exhalation bag and having an interior volume of from 3 to 5 liters and an outer surface area of from 1,500 to 4,000 square centimeters.

* * * * *